US005533824A

United States Patent [19]

Heidenreiter et al.

[11] Patent Number: 5,533,824

[45] Date of Patent: Jul. 9, 1996

[54] WRITING OR DRAFTING INSTRUMENT WITH EXCHANGEABLE WRITING MEDIUM CONTAINER

[75] Inventors: Thomas Heidenreiter; Ute Schmidbauer, both of Nürnberg, Germany

[73] Assignee: J. S. Staedtler GmbH & Co., Nürnberg, Germany

[21] Appl. No.: 277,252

[22] Filed: Jul. 19, 1994

[30] Foreign Application Priority Data

Jul. 20, 1993 [DE] Germany ..... 43 24 113.1

[51] Int. Cl.[6] ..... B43K 5/14; B43K 7/02; B43K 8/18

[52] U.S. Cl. ..... 401/133; 401/134; 401/135

[58] Field of Search ..... 401/132, 133, 401/134, 135, 85

[56] References Cited

U.S. PATENT DOCUMENTS

| | | | |
|---|---|---|---|
| 2,105,600 | 1/1938 | Johndohl et al. | 401/133 |
| 2,409,869 | 10/1946 | Kelley | 401/133 |
| 3,361,516 | 1/1968 | Rigondaud . | |
| 3,399,019 | 8/1968 | Koelichen | 401/134 |
| 4,240,759 | 12/1980 | Matsumoto | 401/85 |
| 4,990,012 | 2/1991 | Groetsch et al. | 401/134 |

FOREIGN PATENT DOCUMENTS

| | | | |
|---|---|---|---|
| 321847 | 4/1915 | Germany | 401/133 |
| 517878 | 2/1931 | Germany | 401/133 |
| 1963329 | 6/1967 | Germany . | |
| 2208111 | 2/1972 | Germany . | |
| 3042035 | 3/1983 | Germany . | |
| 3741886 | 12/1987 | Germany . | |
| 653209 | 2/1963 | Italy | 401/132 |
| 677431 | 2/1964 | Italy | 401/133 |
| 850350 | 10/1960 | United Kingdom | 401/135 |

*Primary Examiner*—Steven A. Bratlie
*Attorney, Agent, or Firm*—Friedrich Kueffner

[57] ABSTRACT

A writing or drafting instrument includes a writing medium container in the form of an exchangeable cartridge and a push member which is axially movable in the shaft of the instrument and is used as an ejector. The cartridge is held in the shaft by a clamping action or a positive locking action. The push member and shaft form a structural group in which the push member and the shaft are movable relative to each other. The push member acts on the cartridge at least during the ejection of the cartridge. The writing tip is exchangeably fastened in the cartridge or in the shaft.

9 Claims, 3 Drawing Sheets

WRITING OR DRAFTING INSTRUMENT WITH EXCHANGEABLE WRITING MEDIUM CONTAINER

BACKGROUND OF THE INVENTION

1. Field of the Invention

The present invention relates to a writing or drafting instrument with a writing medium container in the form of an exchangeable cartridge and with a push member which is axially movable in the shaft of the instrument and is used as an ejector, wherein the cartridge is held in the shaft by a clamping action or a positive locking action.

2. Description of the Related Art

Writing or drafting instruments of the above-described type are known in principle. For example, utility models 1 963 329 and 1 920 667, German Patent 30 42 035 and U.S. Pat. No. 3,361,516 illustrate and describe felt tip pens in which a replaceable cartridge held in a shaft by clamping action or positive locking action is utilized as an exchangeable writing medium container. The cartridges have at their rearward ends closing members which can be used as push members or ejectors and which are constructed in such a way that, after the cartridge has been inserted into the shaft, the cartridge axially protrudes beyond the shaft or closes the open end of the shaft. In the forward end of each cartridge is fixedly arranged a fiber wick as writing element.

When the respective cartridge is replaced, the entire cartridge is replaced. This means that it is always necessary to exchange or discard and replace the push member or ejector as well as the writing element together with the empty cartridge, even though these components are usually still in operating condition and could be reused. In the instruments according to German Utility Model 1 920 667 and U.S. Pat. No. 3,361,516, the manipulation during the exchange of the cartridge additionally poses a significant problem because a separate tool is required for ejecting the cartridge from the shaft, wherein the separate tool may be the protective cap.

In addition, German Laid-Open Application 22 08 111 discloses disposable writing utensils which have a spare writing medium reservoir which, when the main writing medium reservoir has become empty, can be connected to the main reservoir by axially actuating a push member so that the writing medium contained in the spare reservoir can flow into the main reservoir, in order to indicate to the user that the entire writing instrument is now being used in "spare operation" and must be replaced soon.

Accordingly, after the writing medium contained in the spare reservoir has been used up, the entire writing instrument must be disposed of.

SUMMARY OF THE INVENTION

Therefore, it is the primary object of the present invention to provide a reusable writing or drafting instrument whose writing medium container is constructed as an exchangeable cartridge which can be exchanged easily and quickly, and in which the exchange of the cartridge does not produce unnecessary waste components.

In accordance with the present invention, the above object is met by a writing or drafting instrument of the above-described type in which the push member and shaft form a structural group in which the push member and the shaft are movable relative to each other. The push member acts on the cartridge at least during the ejection of the cartridge. The writing tip is exchangeably fastened in the cartridge or in the shaft.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
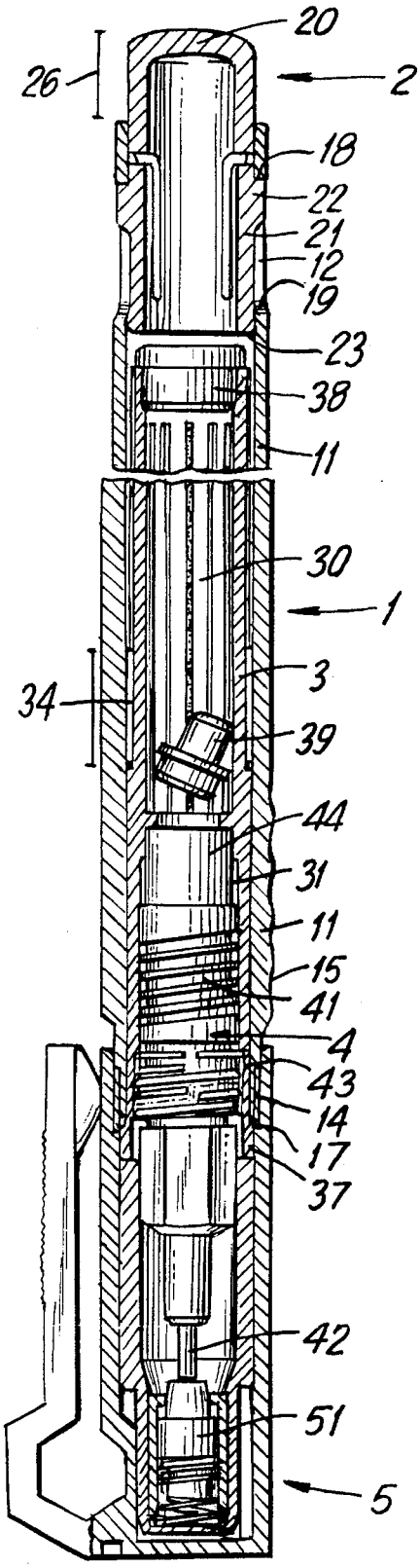
FIG. 1 is a schematic sectional view of a writing instrument according to the present invention with inserted cartridge in the activated operating condition.

FIG. 1 of the drawing shows a writing instrument according to the present invention in which the writing medium container in the form of a cartridge 3 is inserted into a shaft 1 and held in the shaft by a clamping action. The cartridge 3 is shown pierced and, as a result, ready for operation. The shaft 1 is constructed as a single piece and is partially provided with gripping undulations 15.

A push member 2 is arranged in the rearward portion of the shaft 1. A push member cap 20 of the push member 2 protrudes axially beyond the shaft 1. The push member cap 20 is provided with tongue-type webs 21. Stop cams 22 are provided on the webs 21. The stop cams 22 project into openings 12 of the shaft wall 11 and are axially movable between two stops 18 and 19.

The filling space 30 of cartridge 3 contains ink as writing medium and is permanently closed at one side by a closing plug 38 and is closed at the front end by a releasable closing member 39, so that the cartridge can be emptied. In the position shown in FIG. 1, the closing member 39 has already been opened.

A writing tip 4 can be screwed into a compensating zone 31 of the cartridge 3. As shown in FIG. 1, a connecting pin 44 has forced the closing member 39 into the filling space 30 when the cartridge 3 was pierced, so that the writing medium can flow into the interior of the writing tip 4 and, if necessary, also into the compensating system 41. The cartridge 3 has a collar 37 which then securely rests against the stop edge 17 of the shaft 1.

The writing tip 4 is screwed into the cartridge 3 by means of a fastening thread 43. A writing tube 42 of the writing tip 4 is closed in an airtight manner in a storage position from the front by a sealing member 51 of a closing cap 5 which is tightly screwed onto a shaft thread 14 of the housing or shaft.

When the push member 2 is axially actuated by the push member cap 20 after the closing cap 5 has been removed, the end face 23 of the push member cap 20 presses against the closing plug 38 and pushes the entire cartridge 3 out of the shaft 1. The axial length of the effective clamping zone 34 existing between the shaft 1 and the cartridge 3 is advantageously longer than the axial actuating path 26 of the push member 2, so that the cartridge 3 does not unintentionally drop out after full actuation of the push member 2, but can merely be grasped well by the fingers of the user and, if necessary, can be easily forwardly pulled out of the shaft 1. When a new cartridge 3 is inserted, the cartridge 3 is pushed from the front into the shaft 1 until the collar 37 securely rests against the stop edge 17 of the shaft 1 at the end face thereof. In the condition in which the writing instrument is sold, the writing tip 4 is not yet completely inserted into the compensation zone 31 of the cartridge 3, so that the closing member 39 still closes the filling space 30 and, thus, the writing or drafting instrument can be stored for a long period of time.

Figure 2:
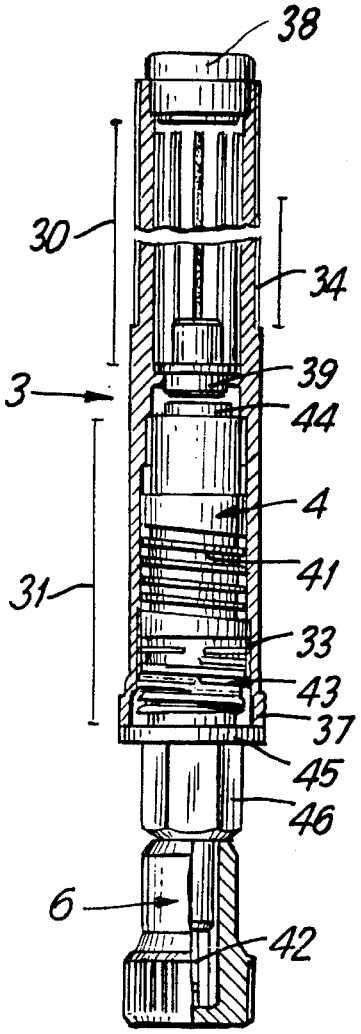
FIG. 2 is a sectional view of the cartridge with inserted writing tip in the non-activated condition.

FIG. 2 of the drawing shows the cartridge 3 of FIG. 1 as a complete structural unit in the condition in which the writing instrument is sold, wherein the writing tip 4 has not yet been completely screwed in and wherein the closing member 39 is rigidly and tightly placed in the closure opening and has not yet been pressed into the filling space 30 by the connecting pin 44. The writing tip 4, which is arranged in a preassembled manner in the compensation zone 31, is provided with a compensating system 41, assembly surfaces 46, a writing tube 42, a releasable securing ring 45 and a removable protective cap 6 and is screwed with a fastening thread 43 into the cartridge thread 33 to such an extent that the securing ring 45 rests against the end face of the collar 37 with a slight pretension. In order to place the writing instrument in operating position or in the position of use, the protective cap 6 is removed, the cartridge 3 is inserted into the shaft 1, not shown in FIG. 2, and is secured through the clamping zone 34, and the writing tip 4 is screwed into the cartridge 3 to such an extent that the securing ring 45 is completely severed from the writing tip 4, on the one hand, and, on the other hand, the closing member 39 is removed from the closure opening or is pressed into the filling space 30 at least to such an extent that the writing medium can flow into the interior of the writing tip 4. The writing instrument is ready for use as soon as all interior spaces of the writing tip 4 have been filled with writing medium up to the tip of the writing tube 42.

Figure 3:
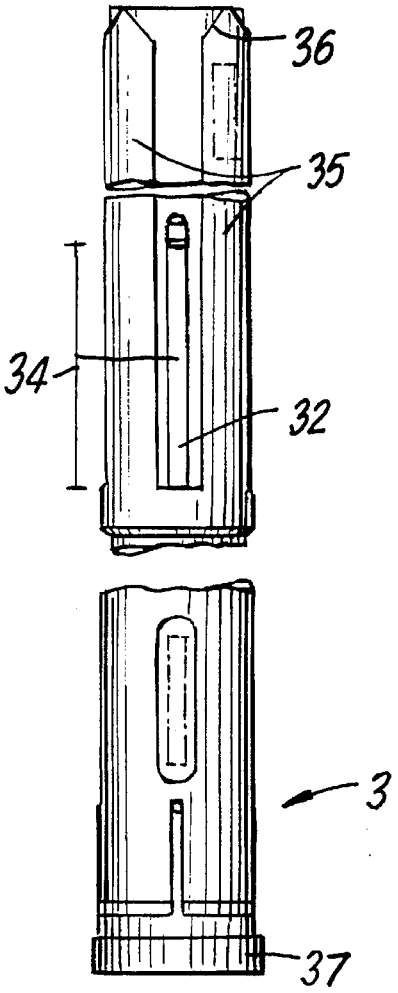
FIG. 3 is a partial side view of the cartridge of the writing instrument of FIGS. 1 and 2.
Figure 4:
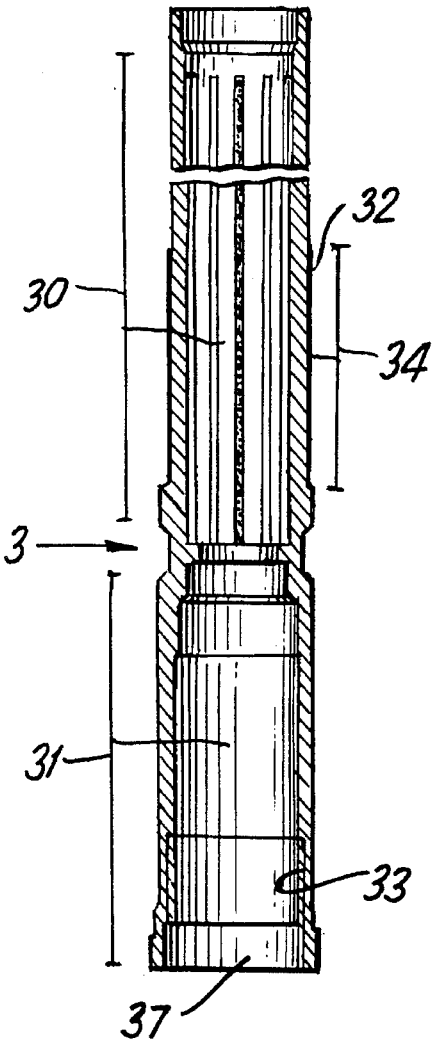
FIG. 4 is a longitudinal sectional view of the cartridge of FIG. 3.

As illustrated in FIGS. 3 and 4, the cartridge 3 has on its outer surface securing webs 35 provided with web points 36 and clamping webs 32 in the clamping zone 34 or between the securing webs 35. The securing webs 35 interact with shaft webs 13 shown in FIG. 5 and, consequently, effect locking against rotation between the shaft 1 and the cartridge 3 in order to make possible or facilitate screwing of the writing tip 4 into or out of the cartridge 3 when the writing tip is to be screwed into the cartridge thread 33.

If plug-in connections are provided exclusively, locking against rotation is unnecessary. The collar 37 limits the depth of insertion of the cartridge 3 relative to the shaft 1, on the one hand, and, on the other hand, the depth by which the writing tip 4 can be screwed into the compensation zone 31 when the securing ring 45 has not yet been removed.

Figure 5:
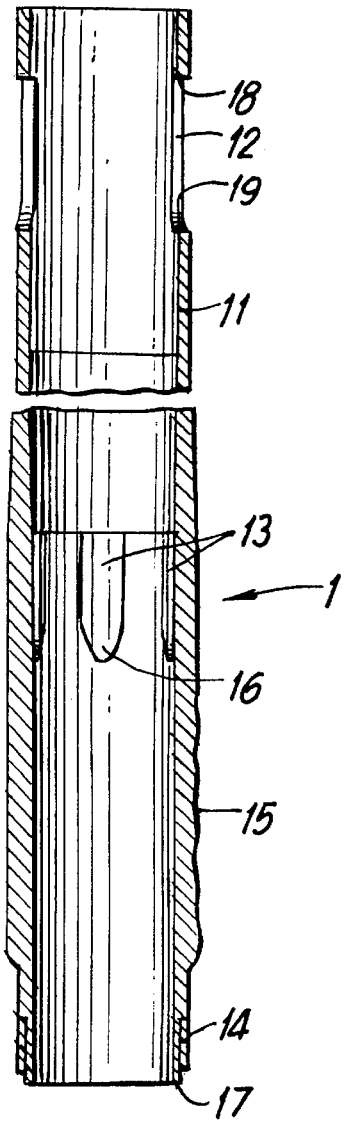
FIG. 5 is a longitudinal sectional view of the shaft of the writing instrument of FIG. 1.
Figure 6:
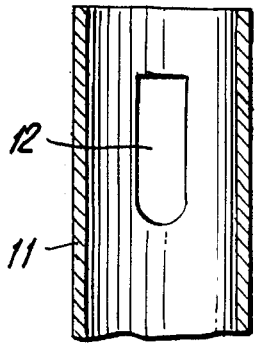
FIG. 6 is a partial sectional view of the shaft of FIG. 5, shown turned by 90°.

The shaft 1 illustrated in FIGS. 5 and 6 has a shaft wall 11 with openings 12, shaft webs 13, gripping undulations 15 and a shaft thread 14. The radially extending window-like openings 12 are provided with axially acting rear and front stops 18 and 19 for securing the push member 2, and the shaft webs 13 arranged in the interior and provided with centering wedges 16 effect together with the securing webs 35 of the cartridge 3 a locking against rotation between the shaft 1 and the inserted cartridge 3 resting against the contact edge 17.

Figure 7:
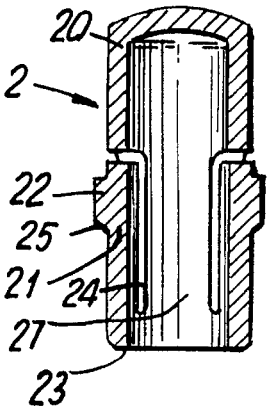
FIG. 7 is a longitudinal sectional view of the push member of the writing instrument of FIG. 1.
Figure 8:
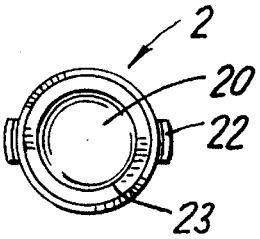
FIG. 8 is a bottom view of the push member of FIG. 7.
Figure 9:
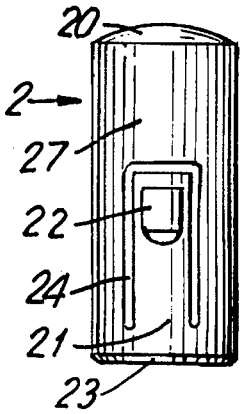
FIG. 9 is a side view of the push member of FIG. 7.

FIGS. 7–9 of the drawing show the push member 2 in three different views. The stop cams 22 mounted on the radially resilient tongue-type webs 21 and provided with insertion inclinations 25 are arranged axially approximately in the center of the push member 2. The push member 2 acts with its end face 23 on the cartridge 3 which, when the cartridge is ejected, comes into contact with the cartridge.

The tongue-type webs 21 are defined by recesses 24 which are formed as radial openings of the push member wall 27. The push member 2 can be mounted by a simple insertion into the shaft 1 which is open at the rear, wherein the tongue-type webs 21 are resilient radially inwardly for overcoming the diameter difference of the stop cams 22 until the stop cams 22 engage in the openings 12 of the shaft 1. For carrying out the disassembly, the stop cams 22 are initially pushed inwardly radially until the push member 2 can be pushed toward the rear and can be removed.

Writing instruments or drafting instruments having a writing medium container in the form of an exchangeable cartridge 3 and a push member 2 which is to be used as an ejector and is axially movable in the shaft 7 and in which the cartridge 3 is held in the shaft 1 by a clamping action or a positive locking action, should preferably be constructed in such a way that the push member 2 and the shaft 1 form a structural group in which the push member 2 and the shaft 1 are movable relative to each other, wherein the push member 2 acts on the cartridge 3 at least during the ejection thereof and the writing tip 4 is exchangeably mounted in the cartridge 3 or in the shaft 1.

The cartridge 3 should have a filling space 30 and/or a compensation zone 31.

It is particularly advantageous if the cartridge 3 and the writing tip 4 form a structural unit and if the writing tip 4 is exchangeably fastened in the cartridge 3.

In accordance with a very advantageous solution, the cartridge 3 and the writing tip 4 are sold only in the preassembled state, wherein the writing tip 4 is not completely inserted into the cartridge 3 and the connecting pin 44 of the writing tip 4 opens the closing member 39 of the cartridge 3 only after the writing tip 4 has been fully inserted into the cartridge 3 and keeps the closing member 39 open in the state of operation.

In accordance with another advantageous feature, the push member 2 is mounted in the shaft 1 so as to be axially movable between two stops 18 and 19 and the shaft 1 has at least one opening 12 in which the push member 2 is held so as to be axially movable to a limited extent. For this purpose, the push member 2 may have tongue-type webs 21 and stop cams 22 by means of which the push member 2 is held in the shaft 1 so as to be axially movable between two stops.

For an easy assembly or a possibly automatic assembly, the tongue-type webs 21 and/or the stop cams 22 should have insertion inclinations 25 extending toward the end face 23.

If components are used which are threadedly engaged with each other, such as, threaded writing tips, it is very advantageous if the shaft 1 has at least one shaft web 13 and the cartridge 3 has at least one securing web 35 for locking against rotation and if each shaft web 13 has a centering wedge 16 and each securing web 35 of the cartridge 3 has a web point 36 for facilitating the insertion.

The cartridge 3 may be provided in the area of the compensation zone 31 with a cartridge thread 33 adapted to the fastening thread of the writing tip 4, so that the two components are fastened relative to each other in a way which makes exchange possible.

For fastening the cartridge 3 in the shaft 1 it is advantageous if at least one clamping web 32 is arranged in the region of a clamping zone 34 on the cartridge 3 between the securing webs 35 or alternatively between two shaft webs 13 on the shaft 1.

The shaft of the writing instrument or drafting instrument according to the present invention may also be constructed in two pieces in the known manner and the writing tip may be received directly in the front portion or the mouthpiece portion. In this case, the shaft is disassembled for exchanging the cartridge, the empty cartridge is separated from the shaft, possibly after the push member has been actuated, and the push member is removed, and the shaft is reassembled after a new cartridge has been inserted.

The invention is not limited by the embodiments described above which are presented as examples only but can be modified in various ways within the scope of protection defined by the appended patent claims.

I claim:

1. A writing or drafting instrument comprising a tubular shaft having an axis and an interior, a writing medium container in the form of an exchangeable cartridge, a push member axially movably mounted in the shaft, wherein the cartridge is held in the shaft by one of a clamping action and a positive locking action, wherein the push member and the shaft form a structural group in which the push member and shaft are movable relative to each other, wherein the push member has means for acting on the cartridge at least during ejection thereof, further comprising a writing tip forming a structural unit with the cartridge, the writing tip being exchangeably fastened in the cartridge, the cartridge having a filling space, wherein the shaft has a shaft wall, the shaft wall having at least one opening, the opening forming the two stops for limiting the axial movement of the push member, wherein the shaft comprises at least one shaft web and the cartridge comprises at least one securing web, and wherein the shaft web and the securing web form a locking means against relative rotation of the shaft and the cartridge, further comprising a clamping zone between the shaft and the cartridge, the clamping zone having an axial length, the push member being movable along an axial path of movement, wherein the axial length of the clamping zone is greater than the axial path of movement of the push member.

2. The writing or drafting instrument according to claim 1, wherein the cartridge has a compensation zone.

3. The writing or drafting instrument according to claim 2, wherein the cartridge has in an area of the compensation zone a cartridge thread adapted to a fastening thread of the writing tip, whereby the cartridge can be replaceably engaged with the writing tip.

4. The writing or drafting instrument according to claim 1, wherein the cartridge has a closing member and the writing tip has a connecting pin, wherein the cartridge and the writing tip are movable between a preassembled position in which the writing tip is not completely inserted in the cartridge and a position of operation in which the connecting pin of the writing tip opens the closing member of the cartridge after the writing tip has been fully inserted into the cartridge and in which the connecting pin holds the closing member open.

5. The writing or drafting instrument according to claim 1, wherein the shaft comprises two stops, the push member being axially movable between the two stops.

6. The writing or drafting instrument according to claim 1, wherein the push member has tongue-type webs and stop cams, the shaft having two stops, the push member being axially movably held in the shaft between the two stops.

7. The writing or drafting instrument according to claim 6, wherein at least one of the tongue-type webs and the stop cams have insertion inclinations extending toward an end face of the push member.

8. The writing or drafting instrument according to claim 1, wherein the at least one shaft web has a centering wedge and the at least one securing web of the cartridge has a web point for facilitating insertion of the cartridge in the shaft.

9. The writing or drafting instrument according to claim 8, wherein the cartridge comprises at least one clamping web between the securing webs.

* * * * *